US008226378B2

(12) United States Patent
Daniëls et al.

(10) Patent No.: US 8,226,378 B2
(45) Date of Patent: Jul. 24, 2012

(54) DEVICE TO PREVENT THE FORMATION OF CONDENSATE IN COMPRESSED GAS AND COMPRESSOR UNIT EQUIPPED WITH SUCH A DEVICE

(75) Inventors: Ivo Daniëls, Boom (BE); Tom Maria Albert De Letter, Evergem (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 1072 days.

(21) Appl. No.: 12/083,697

(22) PCT Filed: Oct. 16, 2006

(86) PCT No.: PCT/BE2006/000114

§ 371 (c)(1),
(2), (4) Date: Apr. 17, 2008

(87) PCT Pub. No.: WO2007/045052

PCT Pub. Date: Apr. 26, 2007

(65) Prior Publication Data

US 2009/0252632 A1 Oct. 8, 2009

(30) Foreign Application Priority Data

Oct. 21, 2005 (BE) ..... 2005/0515

(51) Int. Cl.
*F04B 39/04* (2006.01)
*F04B 39/06* (2006.01)

(52) U.S. Cl. ..... 417/228; 417/278; 417/282; 418/84; 418/87; 700/282

(58) Field of Classification Search ..... 417/228, 417/278, 282, 292; 700/282, 285, 89; 418/84, 418/86, 87

See application file for complete search history.

(56) References Cited

U.S. PATENT DOCUMENTS

| | | | | | |
|---|---|---|---|---|---|
| 4,289,461 | A | * | 9/1981 | van Oorschot et al. | 418/84 |
| 4,431,390 | A | * | 2/1984 | Hart | 418/84 |
| 5,318,151 | A | * | 6/1994 | Hood et al. | 184/6.1 |
| 5,989,312 | A | * | 11/1999 | Barnhard et al. | 95/8 |
| 6,059,540 | A | * | 5/2000 | Ni | 417/295 |
| 7,204,678 | B2 | * | 4/2007 | Truyens et al. | 417/228 |

FOREIGN PATENT DOCUMENTS

| | | |
|---|---|---|
| EP | 0 642 629 A | 3/1995 |
| GB | 2 394 004 A | 4/2004 |
| JP | 6-213188 | 8/1994 |
| JP | 2005-48593 | 2/2005 |

OTHER PUBLICATIONS

International Search Report mailed Jan. 31, 2007 relating to International Application No. PCT/BE2006/000114.

* cited by examiner

*Primary Examiner* — Devon C Kramer
*Assistant Examiner* — Ryan Gatzemeyer
(74) *Attorney, Agent, or Firm* — Bacon & Thomas, PLLC

(57) ABSTRACT

Device to prevent the formation of condensate in compressed gas coming from an oil-injected compressor element which is connected to an oil separator which is connected to the compressor element by an injection pipe, and wherein a cooler is provided in the injection pipe which can be bridged by means of a bypass. A controlled mixing valve is connected to the injection pipe and to the bypass, and a control device controls the mixing valve to adjust the compressed air temperature by adjusting the flow distribution through the mixing valve.

14 Claims, 2 Drawing Sheets

DEVICE TO PREVENT THE FORMATION OF CONDENSATE IN COMPRESSED GAS AND COMPRESSOR UNIT EQUIPPED WITH SUCH A DEVICE

BACKGROUND OF THE INVENTION

1. Field of the Invention

The present invention concerns a device to prevent the formation of condensate in compressed gas.

2. Related Art

In particular, the present invention concerns a device to prevent the formation of condensate in compressed gas coming from an oil-injected compressor element which is provided with an air inlet and a compressed air outlet which is connected to an oil separator which is connected to the above-mentioned compressor element by means of an injection pipe for the injection of oil and whereby a cooler is provided in the above-mentioned injection pipe which can be bridged by means of a bypass.

It is known that, by compressing air, moisture which is present in this air, can condense as the pressure increases.

With oil-injected compressors such as for example oil-injected screw-type compressors, the lubricating and cooling oil which is injected in the compressor element may be polluted by condensate as a result thereof, which results in deteriorated operating characteristics of said lubricating and cooling oil in most cases and in premature wear of the different parts of the cooling system and the compressor system.

In order to prevent the formation of condensate, the compressed air temperature must be forced to above its dew point.

However, one must also keep in mind that, in order to preserve the qualities of the cooling and lubricating oil, the admissible temperature increase is restricted, since too high temperatures may degrade the oil.

U.S. Pat. No. 4,431,390 describes a device of the above-mentioned type which makes use of said principle, and whereby a pneumatically driven valve is provided in the above-mentioned bypass which can be switched in an open and closed position on the basis of periodical measurements of the relative humidity, the ambient temperature, the system pressure and the system temperature.

Such a known device is disadvantageous in that it does not allow for a continuous adjustment of the compressed air temperature, since it can only switch the cooler on or off.

Another disadvantage of such a known device is that it does not allow to swiftly react to sudden load variations in the compressor element, which lead to sudden variations in the compressed air temperature and the compressed air pressure, such that temperature and dew point peaks may occur in the supplied compressed air in case of quick load variations.

SUMMARY OF THE DISCLOSURE

The present invention aims to remedy one or several of the above-mentioned and other disadvantages.

To this end, the present invention concerns a device to prevent the formation of condensate in compressed gas coming from an oil-injected compressor element which is, provided with an air inlet and a compressed air outlet which is connected to an oil separator which is connected to the above-mentioned compressor element for the injection of oil by means of an injection pipe and whereby a cooler is provided in the above-mentioned injection pipe which can be bridged by means of a bypass, and whereby this device is equipped with a controlled mixing valve with an inlet and two outlets, whereby this mixing valve is connected to the above-mentioned injection pipe with an inlet and an outlet, and whereby it is connected to the above-mentioned bypass with the other outlet, and which is provided with a control device and measuring means connected to it so as to control said mixing valve and to adjust the compressed air temperature by adjusting the flow distribution through the mixing valve.

An advantage of such a device according to the invention is that the temperature of the lubricating and cooling oil can be set to any desired value by adjusting the flow distribution of said oil through the cooler and through the bypass, such that, indirectly, also the temperature of the compressed gas can be constantly maintained above its dew point.

The above-mentioned control device can thus react to any situation whatsoever by setting the oil temperature, and consequently also the compressed air temperature to a required value.

Another advantage of such a device according to the invention is that it is capable to react to sudden load variations of the compressor element by controlling the above-mentioned mixing valve in an appropriate manner.

The present invention also concerns a compressor unit with an oil-injected compressor element, which compressor unit is provided with a device as described above to prevent the formation of condensate in compressed gas coming from the above-mentioned compressor element.

BRIEF DESCRIPTION OF THE DRAWINGS

In order to better explain the characteristics of the present invention, the following preferred embodiment of a device according to the invention to prevent the formation of condensate in compressed gas is given as an example only without being limitative in any way, with reference to the accompanying drawings, in which.

DETAILED DESCRIPTION OF PREFERRED EMBODIMENTS OF THE INVENTION

Figure 1:
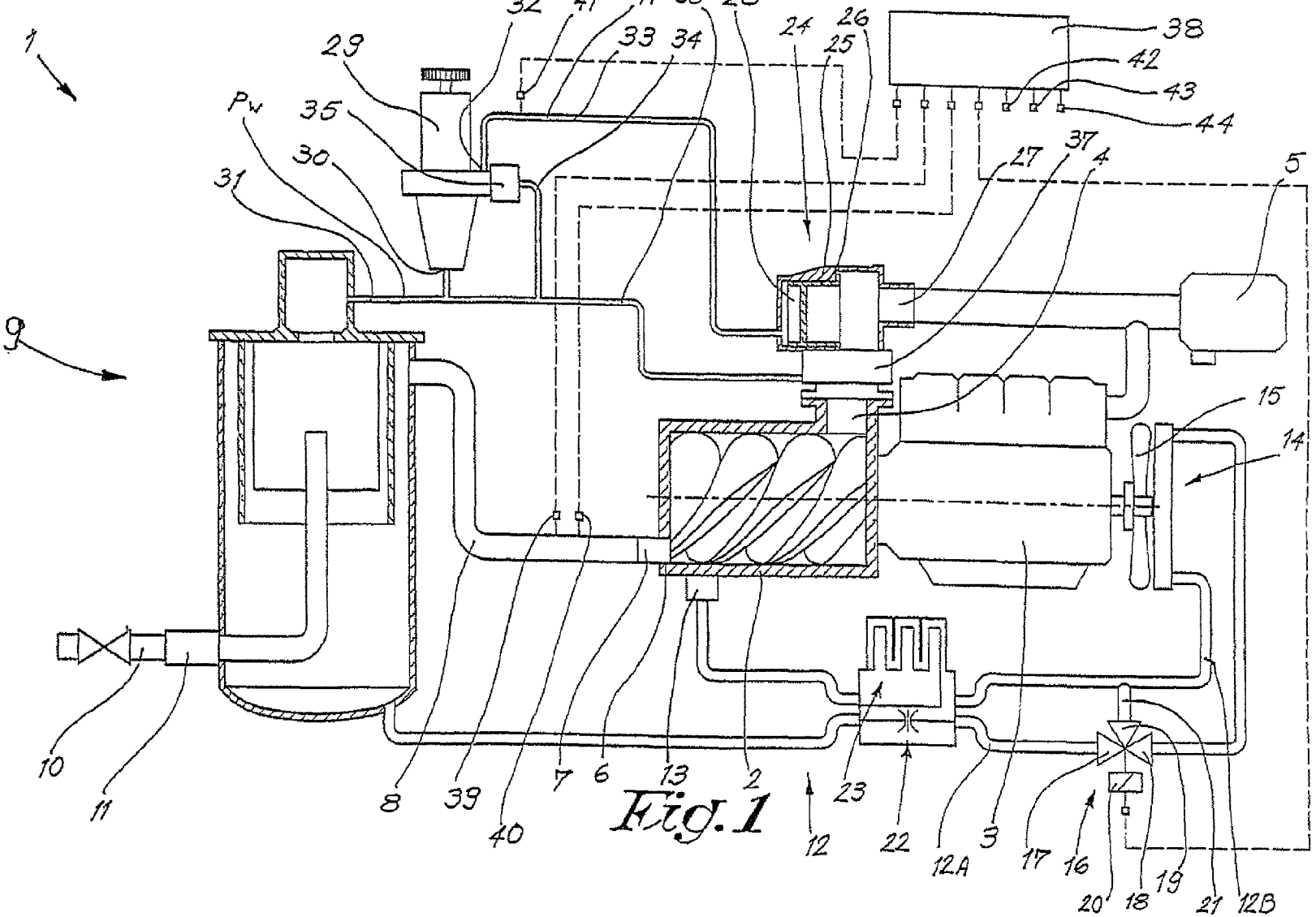
FIG. 1 schematically represents an oil-injected screw-type compressor which is provided with a device according to the invention.

FIG. 1 represents a compressor unit 1 which is in this case made in the shape of an oil-injected screw-type compressor and which is provided with a compressor element 2 which is in this case driven by a thermal motor 3 and which is provided with an air inlet 4 to draw in a gas to be compressed via an air filter 5, and with a compressed air outlet 6 which opens into a pipe 8 via a non-return valve 7 which is connected to an oil separator 9 of a known type.

Via a compressed air line 10 which is connected to the above-mentioned oil separator 9 via a minimum pressure valve 11, compressed gas at a certain working pressure $p_w$ can be taken off by compressed air users, such as for example to feed a compressed air network or the like.

The above-mentioned oil separator 9 is connected to the above-mentioned compressor element 2 by means of an injection pipe 12, in particular by an injection valve 13 which is provided on this compressor element 2.

In the above-mentioned injection pipe 12 is provided a cooler 14 which, in this case but not necessarily, is made in the shape of an air-cooled heat exchanger.

Opposite the above-mentioned cooler 14 is in this case provided a fan 15 which is driven by the above-mentioned thermal motor 3.

According to the invention, the compressor unit 1 is provided with a device to prevent the formation of condensate in the compressed gas, which device is provided with a mixing valve 16 which is in this case made as a controlled 3-way mixing valve with an inlet 17, two outlets 18 and 19 and an electric actuator 20 and which is connected to the above-mentioned injection pipe 12 with its inlet 17 and with an outlet 18, in particular to the first part 12A of this injection pipe 12 which extends between the oil separator 9 and the cooler 14.

The second outlet 19 of the above-mentioned mixing valve 16 is connected to a first far end of a bypass 21 which is connected to the injection pipe 12 with its other far end, in particular to a second part 12B of this injection pipe 12 which extends between the cooler 14 and the compressor element 2, such that the above-mentioned cooler 14 can be bridged.

In the first part 12A of the above-mentioned injection pipe 12 is provided a thermostatic bypass valve 22 of a known type between the oil separator 9 and the mixing valve 16 which can bridge the above-mentioned cooler 14 as it is connected to the above-mentioned second part 12B of the injection pipe 12.

In this case, an oil filter 23 is provided in the above-mentioned second part 12B of the injection pipe which, if necessary, can be integrated in the same housing as the above-mentioned thermostatic bypass valve 22 in the first part 12A of the injection pipe 12.

In a preferred embodiment, the compressor unit 1 is also provided with a flow control device which mainly consists of a compressed air-controlled inlet valve 24 which is provided at the air inlet 4 of the compressor element 2 and which is built in the known manner as a housing 25 in which a valve element 26 can be shifted between an opened position in which the inlet opening for the drawn-in gas is maximal and a closed position in which the inlet opening is entirely closed.

The above-mentioned valve element 26 is closed on one side, in particular on the side opposite the inlet 27 of the inlet valve 24, so as to form a pressure chamber 28.

The flow control device is further provided with a control valve 29 with an inlet 30 which is connected to the above-mentioned oil separator 9 via a first control line 31, whereby a control pressure $p_r$ is supplied to an outlet 32 by said control valve 29 which is a function of the working pressure $p_w$ at its inlet 30.

Typically, as is known, as soon as the working pressure $p_w$ has exceeded a preset threshold value, a control pressure $p_r$ will be built up at the outlet 32 of the control valve 29 which rises for example in proportion to a rising working pressure $p_w$.

The outlet 32 of the control valve 29 is connected to the above-mentioned pressure chamber of the inlet valve 24 via a second control line 33.

Onto the above-mentioned first control line 31 is in this case connected a bypass 34 which is connected to the above-mentioned second control line 33 via a load valve 35.

This load valve 35 is preferably made in the shape of a normally closed valve which can be electromagnetically opened or closed, depending on whether a voltage is either or not applied to the connection terminals of said load valve 35.

Onto the above-mentioned first control line 31 is connected another pipe 36 opening into the housing 25 of the inlet valve 24 via an exhaust valve 37, such that, when this inlet valve 24 is closed, the exhaust valve 37 is opened by the valve element 26, whereas this exhaust valve 37 is closed by the working pressure $p_w$ in the opened position of the inlet valve 24.

According to a preferred characteristic which is not represented in the figures, the outlet 32 of the control valve 29 is connected to a pressure sensor via a control line which can transform the control pressure $p_r$ into an electric signal which is sent to an electronic speed control to adjust the rotational speed n of the thermal motor 3.

The device according to the invention to prevent the formation of condensate is further also provided with a control device 38 onto which the above-mentioned electric actuator 20 of the mixing valve 16 is connected and onto which measuring means are connected as well.

The above-mentioned measuring means are in this case provided, however not in a limitative way, with a temperature sensor 39 and a pressure sensor 40, to determine the compressed air temperature $T_w$ and the working pressure $p_w$ respectively, which sensors 39 and 40 are preferably provided in the pipe 8 between the compressor element 2 and the oil separator 9.

The above-mentioned measuring means in this case also comprise a pressure sensor 41 to determine the control pressure $p_r$, which sensor 41 is provided on the second control line 33.

Further, in a preferred embodiment, the above-mentioned measuring means also comprise means 42 to determine the ambient temperature $T_{amb}$, means 43 to determine the atmospheric pressure $p_{atm}$ and means 44 to determine the relative humidity Rha. Each of these additional measuring means 42 to 44 can for example be placed on the outside of the compressor unit 1.

It is clear that the present invention is not restricted to the presence of all the measuring means 39 to 44, but that it can be restricted to only a part of these measuring means.

The working of a device according to the invention to prevent the formation of condensate in compressed gas is very simple and as follows.

As is known, the valve element 26 is normally in its closed position when the compressor unit 1 is started, since, if the compressor unit 1 was stopped during a preceding use, the working pressure $p_w$ of the oil separator 9 will have been guided to the pressure chamber 28 via the bypass 34, such that the valve element 26 was closed at this working pressure $p_w$.

When the thermal motor 3 is started with the valve element 26 in the closed position so as to drive the compressor element 2, an underpressure $p_0$ is created at the air inlet 4 of the compressor element in relation to the atmospheric pressure $p_{atm}$.

Due to the difference between the atmospheric pressure $p_{atm}$ and the pressure $p_0$, the valve element 26 tends to move into the open position, which is disadvantageous when starting the compressor unit 1, since with an open inlet, a much larger torque is required to start the compressor unit 1.

In order to prevent this, the load valve 35 in the bypass 34 is opened, as is known, by means of an electric signal, such that the working pressure $p_w$ which is built up by the compressor unit 1 is guided to the pressure chamber 28 behind the valve element 26 via the second control line 33.

This working pressure $p_w$ which is guided to the pressure chamber 28 behind the valve element 26 will provide for the necessary counterpressure so as to compensate for the force exerted on the valve element 26 as a result of the difference in pressure $p_{atm}-p_0$, such that the valve element 26 stays closed during the start-up and the compressor element 2 is set to a certain minimal rotational speed thanks to the control pressure in the control line 33 and in the pressure chamber 28. The compressor is now running idle.

The compressor can be loaded by sending an electric signal to the load valve 35 which is then closed, as a result of which the pressure in the pressure chamber 28 of the inlet valve 24 drops to practically the atmospheric pressure $p_{atm}$ via a throttled blow-off opening which is not represented in the figures, such that the force exerted on the valve element 26 as a result of the above-mentioned underpressure $p_0$ in the inlet at the bottom of the valve element 26 is no longer compensated, and the valve element 26 will then shift into the open position.

While the inlet valve 24 is being opened, the pressure $p_0$ behind the valve element 26 rises, until, when the air inlet 4 is entirely opened, the atmospheric pressure $p_{atm}$ prevails there as well.

In order to make the temperature of the cooling and lubricating oil which is injected in the compressor element 2 rise quickly up to a certain nominal value when starting the compressor unit 1, use is made, as is known, of the above-mentioned thermostatic bypass valve 22 which is preferably set at a value between 40° C. and 70° C. and which will bridge the cooler 14 in case of a cold start of the compressor unit 1, or in a cold environment such as for example during winter.

With the necessary additional functionalities in the control device 38, this function can also be assumed by the mixing valve 19 of the present invention.

To this end, the mixing valve 16 can also be used as a thermostatic bypass valve to bridge the cooler 14, to which end the control device 38 can be provided with an algorithm which controls the mixing valve 16 in such a manner that the entire flow of the inlet 17 is sent through the bypass 21 as long as the oil temperature remains under a preset value.

While the compressor unit 1 is operational, the thermal motor 3 drives the compressor element 2, such that damp, atmospheric air is drawn in through the inlet valve 24 via the air filter 5.

In order to discharge compression heat in the compressor element 2, cooled oil coming from the cooler 14 is supplied via the injection pipe 12 and the injection valve 13.

The air and the injected lubricating and cooling oil are mixed in the compressor element 2, such that a mixture of compressed gas and oil is guided to the oil separator 9, where the oil is separated from the compressed air in the known manner under the influence of centrifugal forces.

The purified compressed air can then be taken off for use in all sorts of compressed air applications via the above-mentioned minimum pressure valve 11 and the compressed air line 10.

The oil which is recovered from the compressed air in the oil separator 9 is collected at the bottom in this oil separator 9 and pressed to the cooler 14, through the injection pipe 12, by the pressure $p_w$ prevailing in this oil separator 9, where the oil is cooled by the fan 15 which is in this case driven by the thermal motor 3.

When the load of the compressor element 2 changes, for example due to a varying compressed air take-off, also the working pressure $p_w$ in the oil separator 9 will change.

The control valve 29 transforms these alterations of the working pressure $p_w$ in a control pressure $p_r$, as a result of which the position of the valve element 26 in the inlet valve 24, as well as the speed of the motor 3, is controlled in the known manner, so as to adjust the working point of the compressor unit 1 to the new load condition.

In order to make sure that, for every load condition, the temperature of the compressed air is situated above the dew point, the mixing valve 16 is continuously adjusted by the control device 38 on the basis of measurements of the above-mentioned measuring means 39 to 44.

Figure 2:
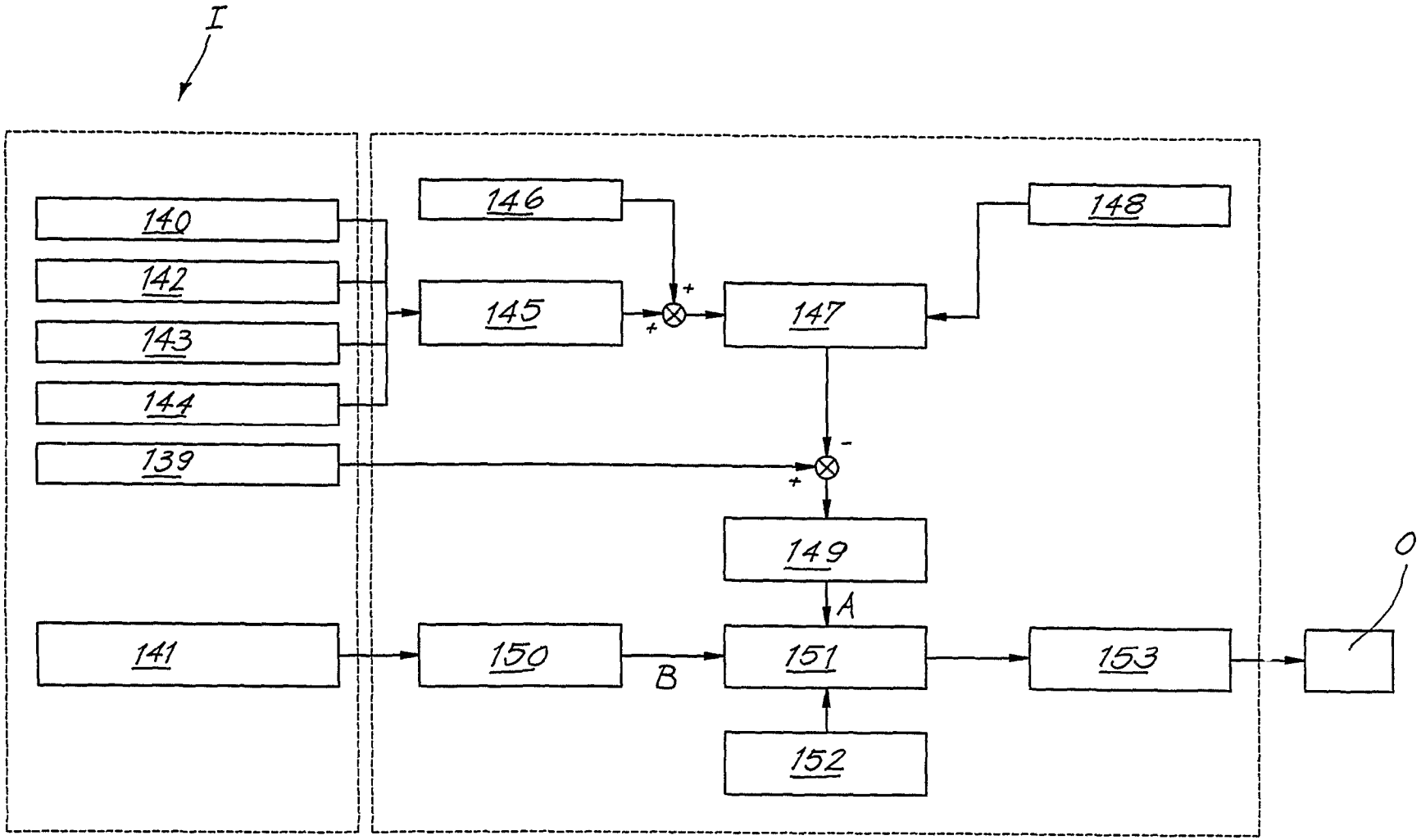
FIG. 2 represents a control scheme of the working of a device as applied in FIG. 1.

FIG. 2 is a schematic representation of the control algorithm of said control device 38, which control algorithm makes sure that a method is followed which makes it possible to respond very swiftly to load variations in the compressor unit 1.

The input data I which are inputted in the control device 38 are all derived from measurements by the above-mentioned measuring means 39 to 44, and they are grouped on the left in the scheme of FIG. 2.

The input data I in this case consist, as described above, of a measurement 139 of the compressed air temperature $T_w$, a measurement 140 of the working pressure $p_w$, a measurement 142 of the ambient temperature $T_{amb}$, a measurement 143 of the atmospheric pressure $p_{atm}$, a measurement 144 of the relative humidity and, if required, a measurement 141 of the control pressure $p_r$.

On the basis of the measurements 140, 142, 143 and 144, the dew point of the compressed air is calculated in a first step 145 of the control algorithm.

It is clear, however, that the ambient parameters, and in particular the ambient temperature $T_{amb}$, the atmospheric pressure $p_{atm}$ and the relative humidity must not necessarily be provided by measuring means 42, 43 and 44 provided to that end, but that they may also be inputted beforehand by a user, for example in the form of limits or average values, and can be stored in a memory of the above-mentioned control device 38.

If necessary, the dew point can be roughly calculated on the basis of the measurement 140 of the compressed air pressure $p_w$ and on the basis of the above-mentioned pre-set values of the ambient temperature $T_{amb}$, the atmospheric pressure $p_{atm}$ and the relative humidity.

In this case, the compressor unit 1 should only be provided with measuring means 40, but not with measuring means 42, 43 and 44.

It is clear that also merely some of the above-mentioned ambient parameters can be measured, whereas the other parameters are inputted by a user.

Finally, it is also possible according to the invention to store a guide value in a memory of the control device 38, and to provide measuring means 142, 143 and 144 as well, such that in case of a malfunction of one of the measuring means, it is still possible to calculate the dew point on the basis of the above-mentioned guide value.

In order to compensate for measuring errors of the measuring means 40, 42, 43 and 44, a correction factor 146 is added following the above-mentioned first step 145, such that an admitted minimum air temperature 147 is obtained, which is taken into account together with the admitted maximum oil temperature 148 as the algorithm continues.

The above-mentioned admitted maximum oil temperature 148 is a constant value which depends on the specific composition of the cooling and lubricating oil which is injected in the compressor element 2.

The calculated admitted minimum air temperature 147 is then compared to the compressed air temperature $T_w$ measured in step 139, and the difference between these values 139 and 147 is then introduced in a control algorithm 149 so as to form a signal A.

On the basis of a continuous measurement 141 of the control pressure $p_r$, a signal B is calculated in step 150 by differentiating the control pressure $p_r$ as a function of time, and by multiplying the result with a constant factor.

In step 151, the above-mentioned signal B is compared to a constant, set minimum load gradient 152.

If the value of signal B exceeds the value 152, then the output value of this step 151 is equated with the signal B. If, however, this signal value B appears to be smaller than the set value 152, then the output value is equated with signal A.

The output value of step 151 is applied to a signal generator 153 which produces an appropriate control signal which serves as the output value 0 of the control device 38 and which is applied to the electric actuator 20 of the mixing valve 16 in order to adjust the flow distribution of the lubricating and cooling oil through this mixing valve 16, and to thus adjust the compressed air temperature in accordance with the load condition and the ambient conditions of the compressor unit 1.

Thanks to this specific method, quick load variations can always be compensated for, which is not possible without any "overshoots" or "undershoots" if only a control algorithm 149 is used.

In case of an "overshoot", the oil would not be sufficiently cooled, as a result of which its temperature could rise above the admitted maximum value and the compressor unit 1 might fall out.

In the case of an "undershoot", the cooling and lubricating oil is cooled too much, as a result of which the compressed air temperature $T_w$ may temporarily drop under the dew point and condensation may occur, as a result of which water may end up in the oil.

According to the invention, the measurement 141 of the control pressure $p_r$ may be replaced by a measurement of the working pressure $p_w$ if necessary. Naturally, both pressure values $p_r$ and $p_w$ can be taken into account.

Since a device according to the invention takes into account all the required parameters, it will only adjust the compressed air temperature when necessary, as opposed to existing devices. Under all circumstances, the temperature of the cooling and lubricating oil will always be kept as low as possible in order to slow down oil degradation, but still high enough to avoid condensation.

As the device as represented in the figures takes into account the atmospheric pressure $p_{atm}$, the formation of condensation in the compressed air can also be counteracted at very large heights, where the atmospheric pressure is considerably lower than at sea level.

It is clear that the invention also applies to any compressed gas whatsoever and thus, the invention is not limited to compressed air.

The present invention is by no means restricted to the embodiments given as an example and represented in the accompanying drawings; on the contrary, such a device according to the invention to prevent the formation of condensate in compressed gas can be made in all sorts of shapes and dimensions while still remaining within the scope of the invention.

The invention claimed is:

1. Device to prevent the formation of condensate in compressed air discharged from an oil-injected compressor element including an air inlet and a compressed air outlet that receives compressed air from the compressor element and which is connected to an oil separator which is connected to the compressor element for the injection of oil via an injection pipe, and further including a cooler in communication with the injection pipe and which is bridged by a bypass, said device comprising:

a controlled mixing valve having a single inlet and two outlets, said mixing valve being connected to the injection pipe at its inlet and at one of said outlets and is connected to the bypass at its other outlet;

said device further comprising a control device and a measuring system connected thereto arranged to control said mixing valve for the adjustment of the temperature of the compressed air by adjusting the flow distribution through the mixing valve, said measuring system comprising at least one of an ambient temperature measuring device, an atmospheric pressure measuring device, and a relative humidity measuring device;

said control device including a control algorithm that calculates the lowest possible compressed air temperature on the basis of measuring signals received from one or several of the measuring devices and sends a signal on the basis thereof to said mixing valve so as to restrict the degradation of the oil due to heating thereof and to avoid the formation of condensate in the compressed air.

2. Device according to claim 1, wherein the measuring system includes a compressed air temperature measuring device that measures the compressed air temperature in the oil separator.

3. Device according to claim 1, wherein the measuring system includes a measuring device that measures the presence of the compressed air.

4. Device according to claim 1, wherein the measuring system includes a control pressure measuring device which is set by a control valve having a control valve inlet connected to the oil separator and a control valve outlet connected to a compressed air-controlled inlet valve which is connected to the air inlet of the compressor element.

5. Device according to claim 1, wherein said mixing valve is provided with an electric actuator which is connected to the control device.

6. Device according to claim 1, wherein the control algorithm is arranged such that the speed of the load variations in the compressor element is taken into account by continuously measuring at least one of the pressure of the compressed air and a control pressure which is a function of the pressure of the compressed air.

7. Device according to claim 3, wherein the control algorithm is arranged such that, on the basis of a continuous measurement of the pressure of the compressed air, a signal value is calculated which is a measure of the load gradient, and said calculated signal value is compared to a preset minimum load gradient, and, if the calculated signal value exceeds the minimum load gradient, the signal value is used to control the mixing valve, and if the signal value is lower than the minimum load gradient, a second calculated signal is generated to control the mixing valve.

8. Device according to claim 7, wherein the control algorithm is arranged such that the second calculated signal is the output value of the control algorithm whose input value amounts to the difference between the measured compressed air temperature and a calculated admitted minimum air temperature.

9. Device according to claim 8, wherein the control algorithm is arranged such that the calculated minimum air temperature is calculated on the basis of a measurement of the pressure of the compressed air.

10. Device according to claim 1, wherein the mixing valve is also configured for use as a thermostatic bypass valve to bridge the cooler, and said algorithm controls the mixing valve in such a manner that the entire flow at the inlet of the mixing valve is controlled by the bypass as long as the oil temperature remains beneath a preset value.

11. Device according to claim 1, wherein the control device is provided with a memory for storing limits or average values which enables calculation of the dew point of the compressed air supplied by the compressor element as a function of one or several measurements of the measuring system.

12. Compressor unit with an oil-injected compressor element, comprising a device according to claim 1 to prevent the formation of condensate in compressed air coming from the compressor element.

13. Device according to claim 3, wherein the control algorithm is arranged such that, on the basis of a continuous measurement of the control pressure, a signal value is calculated which is a measure of the load gradient, and said calculated signal value is compared to a preset minimum load gradient, and, if the calculated signal value exceeds the minimum load gradient, the signal value is used to control the mixing valve, and if the signal value is lower than the minimum load gradient, a second calculated signal is generated to control the mixing valve.

14. Device according to claim 8, wherein the control algorithm is arranged such that the calculated minimum air temperature is calculated on the basis of a measurement of the pressure of the compressed air and on the basis of preset values for the ambient temperature, the atmospheric pressure and the relative humidity of the air drawn in by the compressor element.

* * * * *